US008537079B2

(12) United States Patent
Hekstra et al.

(10) Patent No.: US 8,537,079 B2
(45) Date of Patent: Sep. 17, 2013

(54) METHOD AND APPARATUS FOR POWER CONTROL OF AN ORGANIC LIGHT-EMITTING DIODE PANEL AND AN ORGANIC LIGHT-EMITTING DIODE DISPLAY USING THE SAME

(75) Inventors: Gerben Hekstra, Chu-Nan (TW); Serve Lambie, Chu-Nan (TW); Ron Linssen, Chu-Nan (TW)

(73) Assignee: Chimei Innolux Corporation, Chu-Nan (TW)

( * ) Notice: Subject to any disclaimer, the term of this patent is extended or adjusted under 35 U.S.C. 154(b) by 197 days.

(21) Appl. No.: 13/164,480

(22) Filed: Jun. 20, 2011

(65) Prior Publication Data

US 2012/0019506 A1 Jan. 26, 2012

Related U.S. Application Data

(60) Provisional application No. 61/367,370, filed on Jul. 23, 2010.

(51) Int. Cl.
*G09G 3/30* (2006.01)

(52) U.S. Cl.
USPC ..... 345/76; 345/82

(58) Field of Classification Search
USPC ..... 345/76–77, 82–83
See application file for complete search history.

(56) References Cited

U.S. PATENT DOCUMENTS

| | | | | |
|---|---|---|---|---|
| 6,160,535 | A | 12/2000 | Park | |
| 2003/0201727 | A1 * | 10/2003 | Yamazaki et al. | 315/169.1 |
| 2009/0195484 | A1 * | 8/2009 | Lee et al. | 345/76 |
| 2009/0278774 | A1 | 11/2009 | Chen et al. | |
| 2010/0171774 | A1 * | 7/2010 | Mizukoshi et al. | 345/690 |
| 2010/0277513 | A1 * | 11/2010 | Byun | 345/690 |

FOREIGN PATENT DOCUMENTS

| | | |
|---|---|---|
| CN | 1930603 | 3/2007 |

* cited by examiner

*Primary Examiner* — Chanh Nguyen
*Assistant Examiner* — Long D Pham
(74) *Attorney, Agent, or Firm* — Liu & Liu

(57) ABSTRACT

A power control method, a power control apparatus, and an OLED display are provided. The method includes the steps of: estimating a voltage value according to image content of an image, the voltage value indicative of a minimal required voltage allowing the OLED panel to display the image; and controlling a voltage generator to adjust a booster voltage provided to the OLED panel according to the estimated voltage value.

12 Claims, 6 Drawing Sheets

METHOD AND APPARATUS FOR POWER CONTROL OF AN ORGANIC LIGHT-EMITTING DIODE PANEL AND AN ORGANIC LIGHT-EMITTING DIODE DISPLAY USING THE SAME

This application claims the benefit of U.S. provisional application Ser. No. 61/367,370, filed Jul. 23, 2010, the subject matter of which is incorporated herein by reference.

BACKGROUND OF THE INVENTION

1. Field of the Invention

The invention relates in general to a method and an apparatus for power control and an organic light-emitting diode (OLED) display, and more particularly to a method and an apparatus for power control and an OLED display for adjusting a booster voltage provided to an OLED panel.

2. Description of the Related Art

Generally, an organic light-emitting diode (OLED) is a self-emissive display element that emits light by electrically exciting a luminous organic compound. The OLED has recently received attention and application in the field of the flat panel display, television screens, computer displays, and portable electronic device screens. The OLED, when used in a display, lends itself to several advantages over flat-panel displays, such as its self-emissive ability which retires the backlight of the LED, wider viewing angles, and improved brightness.

The OLED-based displays, however, have a problem related to power consumption. Because of different circuit characteristics in the OLED devices, some consume more power than others. In order to assure that an OLED-based display has sufficient power to display images, the booster voltage, or the power level, is usually set at a level sufficient to allow the OLED-based display to display all kinds of images. In this way, when low brightness levels are required based on the displayed image, the level of the booster voltage remains the same. As a result, excess voltage is applied to the OLED panel, which can also be referred to that excess power that is not as demanding is used, and heat is generated. That heat is undesirable because it causes the problem of power consumption for the OLED-based display.

SUMMARY OF THE INVENTION

The invention is directed to a method and an apparatus for power control, and an organic light-emitting diode (OLED) display for adjusting a booster voltage provided from a voltage generator to an OLED panel, which can reduce power consumption for driving the OLED panel, and result in lower power loss.

According to an aspect of the present invention, a method is provided for power control of an OLED panel. The method includes the steps of: estimating a voltage value according to image content of an image, the voltage value indicative of a minimal required voltage allowing the OLED panel to display the image; and controlling a voltage generator to adjust a booster voltage provided to the OLED panel according to the estimated voltage value.

According to another aspect of the present invention, an OLED display is provided. The OLED display includes an OLED panel and a power control apparatus. The OLED panel has a number of OLED elements for displaying an image. The power control apparatus is for estimating a voltage value according to image content of the image. The voltage value is indicative of a minimal required voltage allowing the OLED panel to display the image. The power control apparatus is for controlling a voltage generator to adjust a booster voltage provided to the OLED panel according to the estimated voltage value.

According to another aspect of the present invention, an apparatus is provided for power control of an OLED panel. The apparatus includes a load current estimation circuit, an OLED current estimation circuit, and a power estimation circuit. The load current estimation circuit is for estimating a first current value according to image content of an image, the first current value relating to a voltage drop of the OLED panel associated with the image. The OLED current estimation circuit for estimating a second current value according to the image content of the image, the second current value relating to a maximal display voltage of the OLED panel associated with the image. The power estimation circuit is for estimating a voltage value according to a combination of the estimated first current value and second current value, the voltage value indicative of a minimal required voltage allowing the OLED panel to display the image, and for controlling a voltage generator to adjust a booster voltage provided to the OLED panel according to the estimated voltage value.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
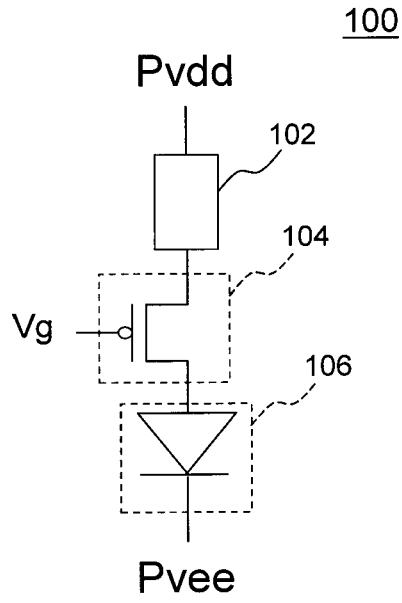
FIG. 1 is a schematic diagram showing a basic panel model of an active matrix organic light-emitting diode (AMOLED) panel.

FIG. 1 is a schematic diagram showing a basic panel model of an active matrix organic light-emitting diode (AMOLED) panel. The panel model 100 includes a panel resistance 102, a switch circuit 104, and an OLED circuit 106. The panel model 100 receives different voltages including power voltage Pvdd and cathode voltage Pvee. The voltage difference between the power voltage Pvdd and the cathode voltage Pvee represents the booster voltage of the OLED panel 100, which can be provided from a voltage generator such as a booster. The panel resistance 102 represents a combinational resistance of various elements on the panel model 100, such as a wiring for the power voltage Pvdd, a wiring for flexible printed circuit (FPC), a wiring for the cathode voltage Pvee, indium tin oxide (ITO) cathode plane, or electrical contact and so on. The switch circuit 104 includes a number of active switch elements such as thin film transistors (TFT). The active switch elements of switch circuit 104 receive a number of control voltages Vg converted from image data of an image, and conduct corresponding currents for the OLED circuit 106. The OLED circuit 106 includes a number of OLED elements which correspondingly receive the currents from the switch circuit 104 and become energized to emit light as the image desired. It is apparent for those skilled in the art that the panel model 100 in FIG. 1 is provided for exemplary illustration, and OLED panels are frequently more complex than that in FIG. 1.

Figure 2:
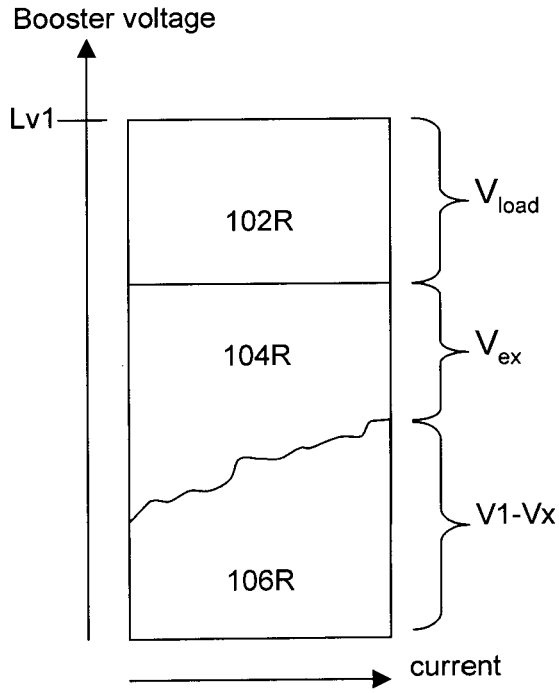
FIG. 2 is a schematic diagram showing the relationship between the booster voltage provided to the panel model in FIG. 1 and the corresponding currents associated with image content of the image.

FIG. 2 is a schematic diagram showing the relationship between the booster voltage provided to the panel model in FIG. 1 and the corresponding currents associated with image content of the image. As shown in FIG. 2, the currents are arranged in an increasing order from left to right. The region 102R represents a voltage drop Vload generated on the panel resistance 102. The region 106R represents a number of display voltages within a range of voltages V1-Vx, such as 3.10-3.70V. Each display voltage is indicative of a drive voltage transmitted to or a pixel data stored across an OLED element of the OLED circuit 106 when an image or a frame is to be displayed thereon, and the display voltage is related to a current flowing therethrough. The active switch elements, when receiving the control voltages and turned on, are operated at an saturation region in which each active switch element has a substantial fixed voltage drop of about 0.5V. Because the booster voltage is usually set at a relatively high level Lv1 in a conventional practice, a high excess voltage Vex shown in region 104R is applied across an active switch element, such as the drain-source junction of a TFT, of the switch circuit 104, resulting in the problem of power consumption. Moreover, heat is generated due to the excess voltage Vex, resulting in accelerating the degradation of the components and shortening the lifetime of the OLED panel.

Figure 3:
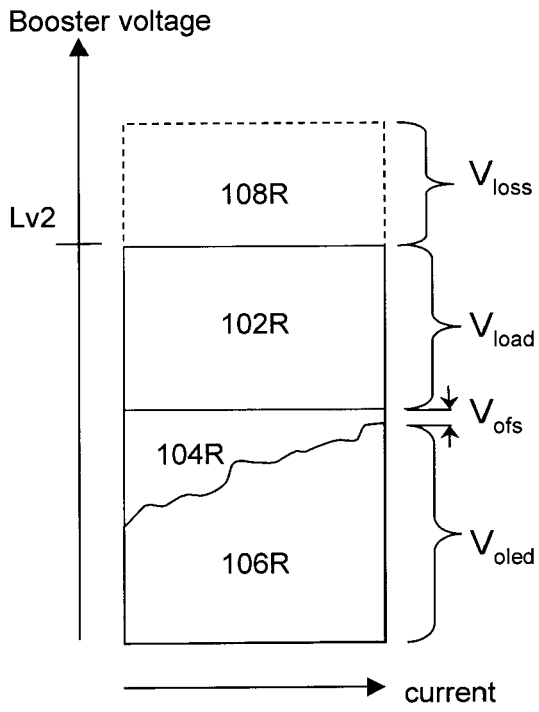
FIG. 3 is a schematic diagram showing the relationship between the booster voltage provided to the panel model in FIG. 1 and the corresponding currents associated with image content of the image according to an embodiment of the invention.

FIG. 3 is a schematic diagram showing the relationship between the booster voltage provided to the panel model in FIG. 1 and the corresponding currents associated with image content of the image according to an embodiment of the invention. As shown in FIG. 3, the horizontal axis indicates the current in an increasing order from left to right. According to an embodiment of the invention, the booster voltage is set at a level associated with the image content and sufficient to allow the OLED panel to display the image, which can also be regarded as each frame or one frame of a video, while the level is adjusted with respect to different images containing different image content. In other words, as shown in FIG. 3, the booster voltage can be set at a lower level Lv2 than the level Lv1, and the level Lv2 of the booster voltage can be determined according to the image content of the image from different voltages of the OLED panel. For example, the level Lv2 can be determined from three voltages measurable on the OLED panel: (1) the voltage drop Vload on the panel resistance 102; (2) the voltage drop on the switch circuit 104 which can be regarded as an offset voltage Vofs about 0.5V; and (3) a maximum display voltage Voled among the display voltages of the OLED elements of the OLED circuit 106. In this way, the booster voltage can be adjusted according to the to-be-display image, so that excess voltage Vloss shown in region 108R can be reduced, making it possible to reduce power consumption for driving the OLED panel, and to lessen power loss.

Figure 4:
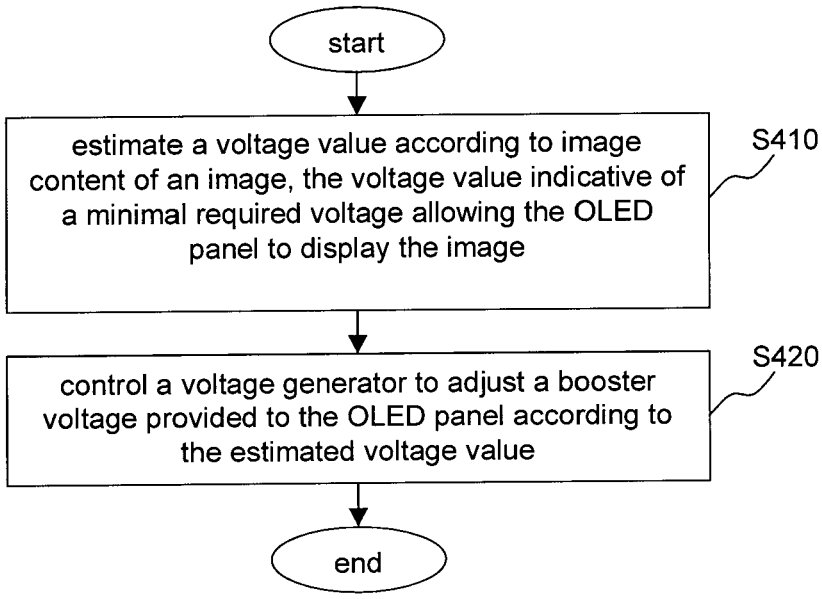
FIG. 4 is a flow chart showing a method for driving an OLED panel according to an embodiment of the invention.

FIG. 4 is a flow chart showing a method for driving an OLED panel according to an embodiment of the invention. The method is used for power control of an OLED panel. The method includes the following steps. In step S410, a voltage value is estimated according to image content of an image, the voltage value indicative of a minimal required voltage allowing the OLED panel to display the image. In step S420, a voltage generator is controlled to adjust a booster voltage provided to the OLED panel according to the estimated voltage value.

According to the aforementioned method for driving the OLED panel, a voltage value, which is indicative of a minimal required voltage sufficient for the OLED panel to display the image, is estimated and used to adjust the booster voltage provided to the OLED panel. Using the voltage value indicative of the minimal required voltage means the booster voltage can be adjusted to an adequate level as a function of the image content, so as to reduce power consumption. Therefore, driving the OLED panel according to the embodiment can result in reduced power consumption.

Figure 5:
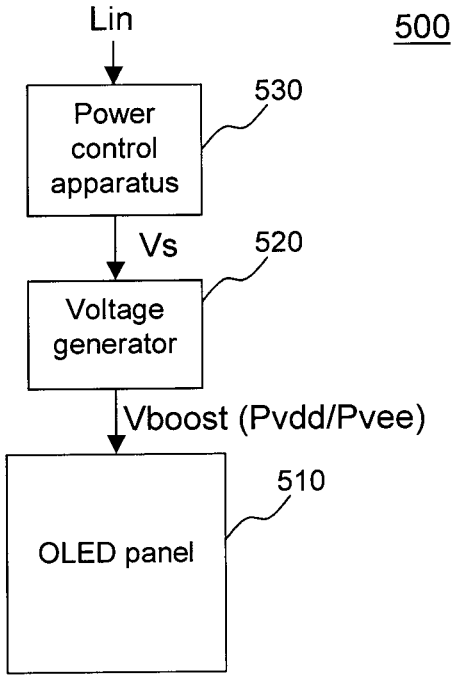
FIG. 5 is a block diagram showing an OLED display according to an embodiment of the invention.

FIG. 5 is a block diagram showing an OLED display according to an embodiment of the invention. The OLED display 500 includes an OLED panel 510, a voltage generator 520, and a power control apparatus 530. The OLED panel 510 has a number of OLED elements for displaying an image and a number of switch elements, while each of the switch element and a corresponding OLED element are defined as a sub-pixel, which is well known in the art. In a practical example, the OLED panel can be a white OLED panel with RGBW color filters, or a side-by-side (SBS) OLED panel where R, G, B OLED materials are deposited in a manner of side-by-side to form patterned RGB sub-pixels, but this invention is not limited thereto. The voltage generator 520 provides a booster voltage Vboost to the OLED panel 510. The booster voltage Vboost is for example represented by the voltage difference between the power voltage Pvdd and the cathode voltage Pvee shown in FIG. 1. The power control apparatus 530 estimates a voltage value Vs according to image content Lin of the image. The image content Lin can be for example image data of the image, or other information retrieved from a portion of image data or all the image data of the image. The voltage value Vs is indicative of a minimal required voltage allowing the OLED panel 510 to display the image. The minimal required voltage can be for example the booster voltage being set at the level Lv2 in FIG. 3. According to the estimated voltage value Vs, the power control apparatus 530 controls the voltage generator 520 to adjust the booster voltage Vboost provided to the OLED panel 510. For example, the power control apparatus 530 can use the voltage value Vs to modify the voltage setting of the voltage generator 520, causing the voltage generator 520 to set the booster voltage Vboost at the level Lv2.

Figure 6:
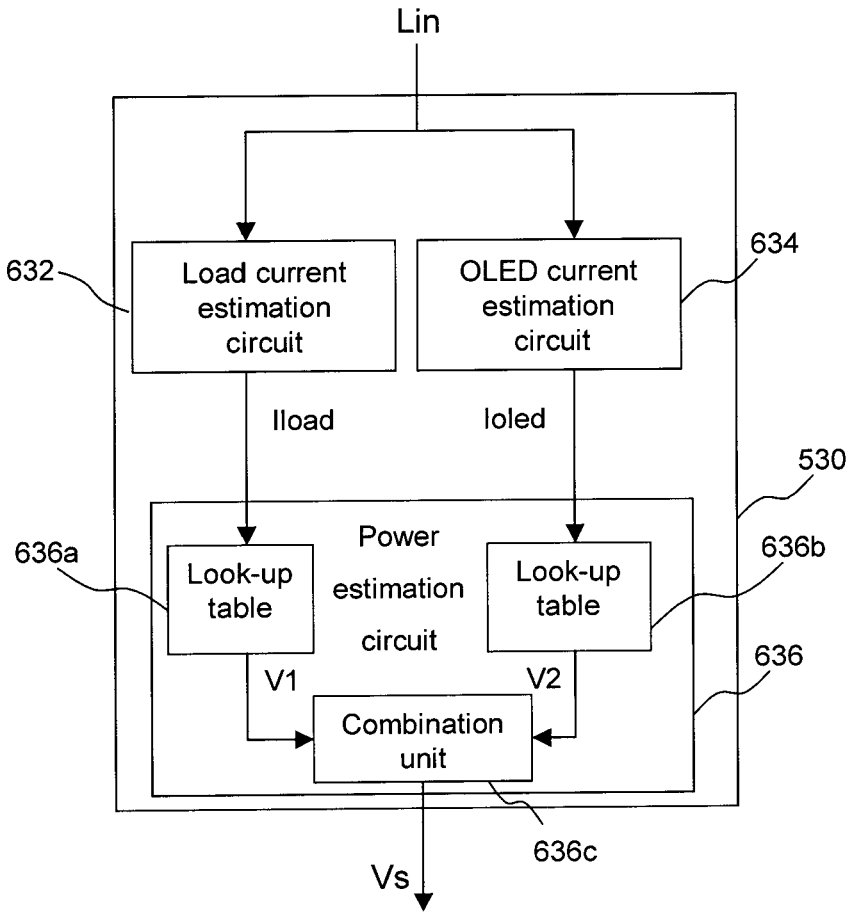
FIG. 6 is a block diagram showing an example of a power control apparatus of the OLED display in FIG. 5 according to an embodiment of the invention.

FIG. 6 is a block diagram showing an example of a power control apparatus of the OLED display in FIG. 5 according to an embodiment of the invention. The power control apparatus 530 includes a load current estimation circuit 632, an OLED current estimation circuit 634, and a power estimation circuit 636. The load current estimation circuit 632 estimates a first current value Iload according to the image content Lin. The first current value Iload is for example indicative of a load current flowing through the OLED panel associated with the image. The OLED current estimation circuit 634 estimates a second current value Ioled according to the image content Lin. The second current value Ioled is for example indicative of a maximal current flowing through one of the OLED elements of the OLED panel 510 associated with the image.

In a practical example, in order for the power control apparatus 530 in FIG. 6 to estimate current values Iload and Ioled, the image content Lin can be the information of luminance values converted from the image data of the image. As to an AMOLED, the current flowing through a single pixel can be estimated as a value proportional to the square of its drive voltage, and linearly proportional to the luminance of its sub-pixels. In other words, in the example of FIG. 6, the luminance value of a sub-pixel, which is converted from the square value of a piece of raw image data, is served as the image content Lin and provided to the current estimation circuits 632 and 634 for current estimation. However, this invention is not limited thereto. The conversion from image data to luminance can be completed in another example where the gamma correction is taken into consideration. In addition to the luminance, the image content Lin can be other information which a person having ordinary skill in the art could use to estimate the current values.

As to the operation of the current estimation circuits 632 and 634, estimating the current values Iload and Ioled involve a weighted summation which is related to the converted luminance values and a number of weighting values. Further description is provided as follows for illustration.

In an embodiment, the first current value Iload is estimated according to a number of sub-pixel luminance values and a number of corresponding weighting values. Each sub-pixel luminance value can be converted from a corresponding primary color sub-pixel data. For example, it is exemplified that the OLED panel 510 includes four kinds of primary color sub-pixel each including an OLED element and a corresponding active switch element, and the first current value Iload can be estimated in accordance with the equation EQ. 1 as follows:

$$I_{load} = \sum_{x=R,G,B,W} F_{load,x} \cdot \sum_{i=1 \ldots N} L_{x,i} \qquad \text{EQ. 1}$$

wherein $I_{load}$ represents the first current value Iload; Lx,i (x=R, G, B, W)(i=1:N) represent four sub-pixel luminance values for N pixels; and Fload,x(x=R, G, B, W) represent four weighting values for the four sub-pixel luminance values.

Figure 7:
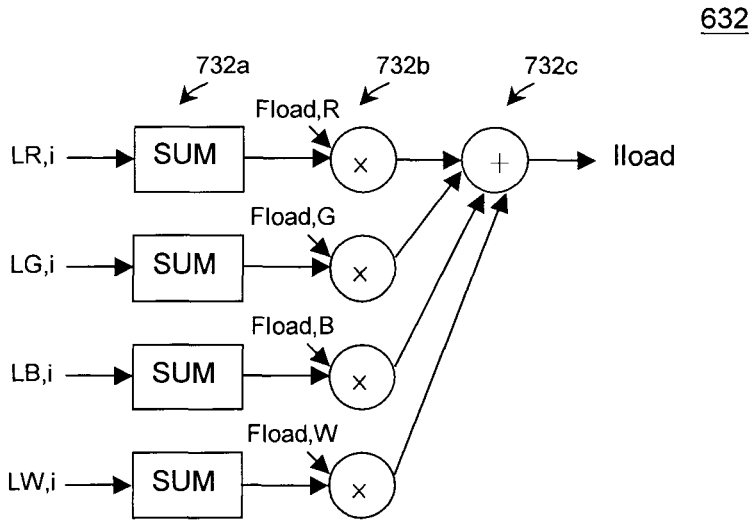
FIG. 7 is a block diagram showing an example of a load current estimation circuit of the power control apparatus in FIG. 6 in accordance with the equation EQ. 1.

FIG. 7 is a block diagram showing an example of a load current estimation circuit of the power control apparatus in FIG. 6 in accordance with the equation EQ. 1. The load current estimation circuit 632 includes four summation units 732*a*, four multipliers 732*b*, and a summation and output unit 732*c*. The four summation units 632*a* receive and sum up four primary color sub-pixel data LR,i, LG,i, LB,i, LW,i, and transmit their results to the four multipliers 732*b*, respectively. The four multipliers 732*b* multiply the results of the summation units 732*b* with four weighting values Fload,R, Fload,G, Fload,B, Fload,W, respectively. The summation and output unit 732 receives and sums up the results of the four multipliers 732*b*, thus providing the first current value Iload.

In an embodiment, the second current value Ioled is estimated according to a number of sub-pixel luminance values and a number of corresponding weighting values. As is similar to the aforementioned example of estimating the first current value Iload where the OLED panel 510 includes four kinds of primary color sub-pixel, the second current value Ioled can be estimated in accordance with the equation EQ. 2 as follows:

$$I_{oled} = \max_{x=R,G,B,W} \left( F_{oled,x} \cdot \max_{i=1 \ldots N} L_{x,i} \right) \qquad \text{EQ. 2}$$

wherein $I_{oled}$ represents the second current value Ioled; Lx,i (x=R, G, B, W)(i=1:N) represent four sub-pixel luminance values for N pixels; and Foled,x(x=R, G, B, W) represent four weighting values for the four sub-pixel luminance values.

Figure 8:
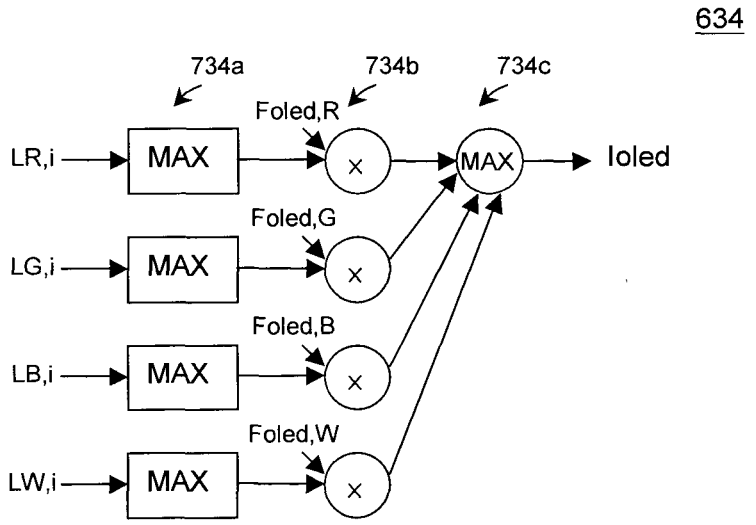
FIG. 8 is a block diagram showing an example of an OLED current estimation circuit of the power control apparatus in FIG. 6 in accordance with the equation EQ. 2.

FIG. 8 is a block diagram showing an example of an OLED current estimation circuit of the power control apparatus in FIG. 6 in accordance with the equation EQ. 2. The OLED current estimation circuit 634 includes four maximum units 734*a*, four multipliers 734*b*, and a maximum and output unit 734*c*. The four maximum units 734*a* receive and obtain four maximum from four primary color sub-pixel data LR,i, LG,i, LB,i, LW,i, and transmit their results to the four multipliers 734*b*, respectively. The four multipliers 734*b* multiply the results of the maximum units 734*b* with four weighting values Foled,R, Foled,G, Foled,B, Foled,W, respectively. The maximum and output unit 734*c* receives and obtain a maximum from the results of the four multipliers 734*b*, thus providing the second current value Ioled.

As to the implementation of the summation units 732*a*, the maximum units 734*a*, and the output unit 732*c* and 734*c*, their circuit architectures can be implemented by logistic elements such as adders, flip-flops, and/or comparators connected in open and/or closed loops. It is apparent for those skilled in the art to implement such devices or circuits which perform the function based on equations EQ. 1 and EQ. 2.

Based on the equations EQ. 1 and EQ. 2, the OLED panel 510 is exemplified as including four kinds of primary color sub-pixel. However, this invention is not limited thereto. In another embodiment, the OLED panel 510 can also be implemented as one which includes three kinds primary color sub-pixel, such as RGB sub-pixels where R, G, B OLED materials are deposited thereon. In this way, each of the equations EQ. 1 and EQ. 2 can be accordingly modified as one where x=R, G, B. Besides, the weighting values for each primary color sub-pixel can also provide the flexibility to circuit design. For example, the weighting values can be the same or different or can be determined according to the aperture sizes or the layout areas of these primary color sub-pixels.

The power control apparatus mentioned in above examples is exemplified to deal with all the image data of the image, but this invention is not limited thereto. In another embodiment, instead of dealing with all the image data of the image, the power control apparatus can also deal with a portion of image data so as to determine the voltage value. For example, the power control apparatus can calculate a weighted summation and maximum of a portion of sub-pixel luminance values, and normalize the calculation results to estimate the first current value Iload and the second current value Ioled. It is apparent for those skilled in the art that the image content can be retrieved from a portion of image data or all the image data of an image. Any estimation approach of the minimal required voltage and any adjustment to the booster voltage as a function of the image content of the image are regarded as a practicable embodiment of the invention.

Referring to FIG. 6, the power estimation circuit 636 estimates a first voltage value V1 indicative of the voltage drop Vload in FIG. 1 according to the estimated first current value Iload, and estimates a second voltage value V2 indicative of the maximal display voltage Voled according to the estimated second current value Ioled. In an embodiment, the power estimation circuit 636 includes two look-up tables 636*a* and 636*b*. The power estimation circuit 636 determines the first voltage value V1 according to the first current value Iload and the look-up table 636*a*, and determines the second voltage value V2 according to the second current value Ioled and the look-up table 636*b*. In accordance with the resistive relationship between voltages and currents, i.e. V=R*I, the first voltage value V1 and the second voltage value V2 can be obtained in a manner of using multipliers each containing a gain indicative of the resistive relationship between voltage and current. To take nonlinear effect into account, conversion of voltage and current in this embodiment can be implemented as look-up tables which contain voltage values and current values establishing the corresponding relationship between voltages and currents, i.e. V=LUT(I). In a practical example, the look-up tables 636*a* and 636*b* can be obtained from experimental results and designed to meet different requirements.

In this embodiment, the power estimation circuit 636 can also include a combination unit 636*c*, with which the power estimation circuit 636 can determine the voltage value Vs indicative of the minimal required voltage according to a combination of the estimated first voltage value V1 and second voltage value V2. In another embodiment, the power estimation circuit 636 can further estimate an offset voltage value. The offset voltage value is indicative of an offset voltage such as the offset voltage Vofs shown in FIG. 3 which allows the switch elements of the OLED panel 510 to operate in saturation mode. The offset voltage Vofs is for example about 0.5V. The offset voltage Vofs can be transmitted to the combination unit 636*c* (not shown in FIG. 6) for making its combination estimation. As such, the power estimation circuit 636 can determine the voltage value Vs indicative of the minimal required voltage according to a combination of the first voltage value V1, the second voltage value V2, and the offset voltage value Vofs, thus providing a resulted voltage being set at the level Vp2 as shown in FIG. 3.

Moreover, in another embodiment, the OLED display 500 can further include a driver integrated chip (IC) not shown in the drawings. The drive IC uses the image content Lin to drive the OLED panel 510, so as to display the image. For example, the drive IC can convert the raw image data into corresponding control voltages such as the control voltages Vg shown in FIG. 1. In this embodiment, the power control apparatus of this embodiment can be implemented in the drive IC, but this embodiment is not limited thereto. The power control apparatus can also be implemented in another place capable of receiving the image content and controlling the voltage generator.

Figure 9:
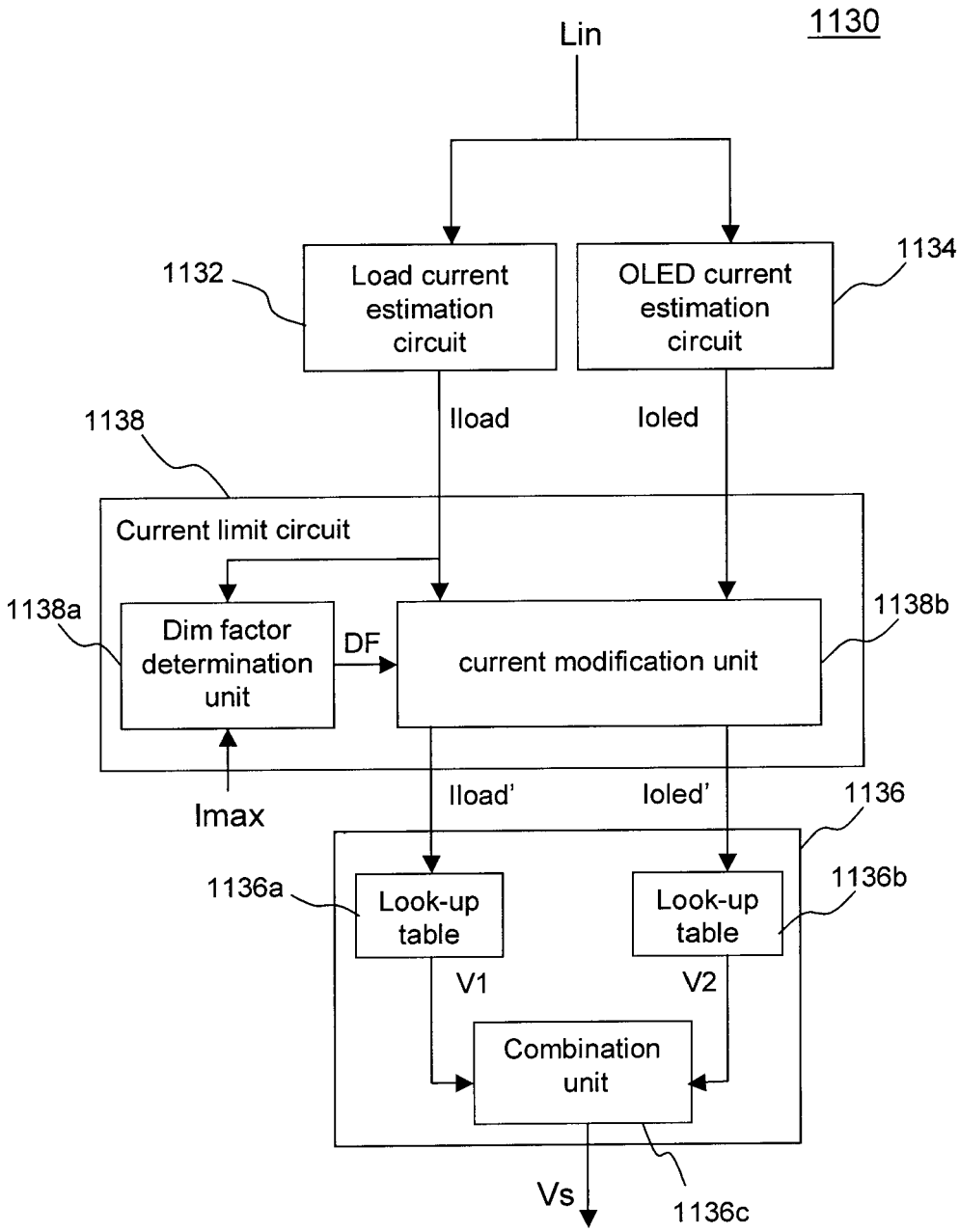
FIG. 9 is a block diagram showing a power control apparatus of the OLED display in FIG. 5 according to another embodiment of the invention.

FIG. 9 is a block diagram showing a power control apparatus of the OLED display in FIG. 5 according to another embodiment of the invention. In this embodiment, as is similar to the power control apparatus 530 in FIG. 6, the power control apparatus 1130 includes a load current estimation circuit 1134 and an OLED current estimation circuit 1134, whose operation will not be repeated for the sake of brevity. The power control apparatus 1130 further includes a current limit circuit 1138. The current limit circuit 1138 limits the estimated first current value Iload and the estimated second current value Ioled. The current limit circuit 1138 includes a dim factor determination unit 1138*a* and a current modification unit 1138*b*. The dim factor determination unit 1138*a* determines a dim factor DF according to a ratio of a limit current value Imax and the first current value Iload. The limit current value Imax can be a user-defined value or can be adjusted to meet different requirements. The current modification unit 1138*b* modifies the first current value Iload and the second current value Ioled according to the dim factor DF. For example, the current modification unit 1138*b* can be a multiplier, which multiplies the first current value Iload and the second current value Ioled respectively with a gain represented by the dim factor DF, and produces the limited first current value Iload' and the limited second current value Ioled'. Receiving the limited first current value Iload' and the limited second current value Ioled', the power estimation circuit 1136 determines the first voltage value V1 and the second voltage value V2 according to the look-up tables 1136*a* and 1136*b*, and determines the voltage value Vs indicative of the minimal required voltage according to a combination of the estimated first voltage value V1 and second voltage value V2.

Besides, the power requirements for OLED elements to maintain the same level of luminance may increase with age due to their degradation. To compensate for the degradation of OLED elements and the aging OLED panel, the power control apparatus of this embodiment can control the voltage generator to adjust the level of the booster voltage adequately in response to the measured current or the measured luminance or brightness of the OLED elements. For example, the embodiment can further include a detector and a compensation look-up table (no shown). The detector can be used to detect the measured current or the measured luminance or brightness of the OLED elements. The compensation look-up table can be used to provide the relationship between the booster voltage and the current flowing through the OLED element or the luminance measured therefrom, the stored content of which the power control apparatus can use to determine the voltage value indicative of the minimal required voltage. As compared with a conventional practice which initially sets booster voltage at a relatively high level, the embodiment using the detector and the compensation look-up table gradually increases the booster voltage provided to the OLED panel to compensate for the degradation of OLED elements and the aging OLED panel, so as to drive the OLED panel with reduced booster voltage and lower power loss.

According to the OLED display and the method for driving the same disclosed in the embodiment of the invention, the booster voltage provided to the OLED panel is adjusted, based on the image content, to an adequate level for allowing the OLED panel to display the image, so that excess voltage can be reduced. Therefore, lower power loss and higher power efficiency can be achieved. Moreover, the lifetime of the OLED display can be lengthened due to the reduced booster voltage.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for power control of an organic light-emitting diode (OLED) panel, comprising:

estimating a voltage value according to an image data of an image, the voltage value indicative of a minimal required voltage allowing the OLED panel to display the image;

estimating a first current value according to a plurality of luminance values converted from the image data, the first current value indicative of a load current flowing through the OLED panel associated with the image;

estimating a second current value according to the plurality of luminance values converted from the image data, the second current value indicative of a maximal current flowing through one of a plurality of OLED elements of the OLED panel associated with the image;

estimating a first voltage value according to the estimated first current value, the first voltage value indicative of a voltage drop of the OLED panel associated with the image;

estimating a second voltage value according to the estimated second current value, the second voltage value indicative of a maximal display voltage of the OLED panel associated with the image;

determining the voltage value indicative of the minimal required voltage according to a combination of the estimated first voltage value and the estimated second voltage value; and controlling a voltage generator to adjust a booster voltage provided to the OLED panel according to the voltage value indicative of the minimal required voltage.

2. The method according to claim 1, wherein in the step of estimating the first current value according to the plurality of luminance values converted from the image data of the image, the first current value is estimated according to a plurality of sub-pixel luminance values and a plurality of corresponding weighting values.

3. The method according to claim 1, wherein the first voltage value is determined according to the first current value and a look-up table.

4. The method according to claim 1, wherein in the step of estimating the second current value according to the plurality of luminance values converted from the image data, the second current value is estimated according to a plurality of sub-pixel luminance values and a plurality of corresponding weighting values.

5. The method according to claim 1, wherein the second voltage value is determined according to the second current value and a look-up table.

6. The method according to claim 1, wherein the step of estimating the first voltage value comprises:

determining the first voltage value indicative of the voltage drop according to the estimated first current value;

wherein the step of estimating the second voltage value comprises:

determining the second voltage value indicative of the minimal required voltage according to the estimated second current value.

7. The method according to claim 6, further comprises:

limiting the estimated first current value and the estimated second current value, wherein in the steps of determining the first voltage value and the second voltage value, the first voltage value and the second voltage value are determined according to the limited first current value and the limited second current value, respectively.

8. The method according to claim 7, wherein the step of limiting the estimated first value and the estimated second value comprises:

determining a dim factor according to a ratio of a limit current value and the first current value; and modifying the first current value and the second current value according to the dim factor.

9. An organic light-emitting diode (OLED) display, comprising:

an OLED panel having a plurality of OLED elements for displaying an image;

a load current estimation circuit for estimating a first current value according to a plurality of luminance values converted from an image data of the image, the first current value indicative of a load current flowing through the OLED panel associated with the image;

an OLED current estimation circuit for estimating a second current value according to the plurality of luminance values converted from the image data of the image, the second current value indicative of a maximal current flowing through one of a plurality of OLED elements of the OLED panel associated with the image;

a power estimation circuit for determining an estimated first voltage value indicative of the voltage drop according to the estimated first current value and determining an estimated second voltage value indicative of the maximal display voltage according to the estimated second current value; and a power control apparatus for estimating a voltage value according to the image data of the image, the voltage value indicative of a minimal required voltage allowing the OLED panel to display the image, and for controlling a voltage generator to adjust a booster voltage provided to the OLED panel according to the estimated first voltage value and the estimated second voltage value.

10. The display according to claim 9, wherein the second current value is estimated according to a plurality of sub-pixel luminance values and a plurality of corresponding weighting values.

11. An apparatus for power control of an organic light-emitting diode (OLED) panel, comprising:

a load current estimation circuit for estimating a first current value according to an image data of an image, the first current value relating to a voltage drop of the OLED panel associated with the image;

an OLED current estimation circuit for estimating a second current value according to the image data of the image, the second current value relating to a maximal display voltage of the OLED panel associated with the image;

a power estimation circuit for estimating a voltage value according to a combination of the estimated first current value and the estimated second current value, the voltage value indicative of a minimal required voltage allowing the OLED panel to display the image, and for controlling a voltage generator to adjust a booster voltage provided to the OLED panel according to the estimated voltage value;

a current limit circuit for limiting the estimated first current value and the estimated second current value; and wherein the power estimation circuit determines the voltage value according to the limited first current value and the limited second current value.

12. The apparatus according to claim 11, wherein current limit circuit comprises:

a dim factor determination unit for determining a dim factor according to a ratio of a limit current value and the first current value; and a current modification unit for modifying the first current value and the second current value according to the dim factor.

* * * * *